US010937285B2

(12) United States Patent
Fortin et al.

(10) Patent No.: US 10,937,285 B2
(45) Date of Patent: Mar. 2, 2021

(54) SYSTEMS AND METHODS OF ALARM CONTROLS AND DIRECTED AUDIO EVACUATION

(71) Applicant: Johnson Controls Fire Protection LP, Boca Raton, FL (US)

(72) Inventors: Maxime Fortin, La Prairie (CA); Thomas Wysong Connell, II, Westminster, MA (US)

(73) Assignee: Johnson Controls Fire Protection LP, Boca Raton, FL (US)

( * ) Notice: Subject to any disclaimer, the term of this patent is extended or adjusted under 35 U.S.C. 154(b) by 0 days.

(21) Appl. No.: 16/420,428

(22) Filed: May 23, 2019

(65) Prior Publication Data

US 2019/0371137 A1 Dec. 5, 2019

Related U.S. Application Data

(60) Provisional application No. 62/679,323, filed on Jun. 1, 2018.

(51) Int. Cl.
*G08B 25/08* (2006.01)
*G08B 7/06* (2006.01)
(Continued)

(52) U.S. Cl.
CPC ..... *G08B 7/066* (2013.01); *G08B 3/10* (2013.01); *G08B 19/00* (2013.01)

(58) Field of Classification Search
CPC ..... G08B 7/066; G08B 3/10; G08B 19/00; G08B 25/14; G08B 29/18
(Continued)

(56) References Cited

U.S. PATENT DOCUMENTS 2,694,847 A 11/1954 Christiansen
4,642,956 A 2/1987 Harbeke
(Continued)

FOREIGN PATENT DOCUMENTS

DE 10140942 C1 8/2003
EP 0 196 55 A1 12/1980
(Continued)

OTHER PUBLICATIONS

Foreign Search Report on EP 19176903.3, dated Oct. 22, 2019, 9 pages.

(Continued)

*Primary Examiner* — Tanmay K Shah
(74) *Attorney, Agent, or Firm* — Foley & Lardner LLP

(57) ABSTRACT

A signaling device control system includes a user interface and an association mapper. The user interface presents a user interface tool including one or more features of a building and receives inputs indicating a boundary of the building, a predetermined equation parameter, (iii) an initiating device assigned to a space defined by the boundary, and a signaling device assigned to the space defined by boundary. The association mapper generates a response function defining a response of the signaling device to a detection signal outputted by the initiating device based on the inputs, and outputs instructions to at least one of the signaling device and a fire control panel that controls operation of the signaling device to cause the signaling device to execute the response defined by the response function in response to the detection signal.

22 Claims, 6 Drawing Sheets

(51) Int. Cl.
*G08B 3/10* (2006.01)
*G08B 19/00* (2006.01)

(58) Field of Classification Search
USPC ..... 340/692
See application file for complete search history.

(56) References Cited

U.S. PATENT DOCUMENTS

| | | | | |
|---|---|---|---|---|
| 2005/0119767 | A1 | 6/2005 | Kiwimagi et al. | |
| 2010/0319196 | A1 | 12/2010 | Rosenberg | |
| 2014/0091197 | A1 | 4/2014 | Abels et al. | |
| 2016/0049064 | A1* | 2/2016 | McNabb | G08B 21/10 340/540 |
| 2016/0327293 | A1 | 11/2016 | Grabowski et al. | |
| 2017/0325056 | A1* | 11/2017 | Mehta | H04M 11/04 |

FOREIGN PATENT DOCUMENTS

| | | | |
|---|---|---|---|
| EP | 3 113 136 | | 1/2017 |
| WO | WO-2015/076680 | A1 | 5/2015 |

OTHER PUBLICATIONS

International Search Report and Written Opinion on International Application No. PCT/IB2020/057165, dated Nov. 17, 2020, 9 pages.

* cited by examiner

SYSTEMS AND METHODS OF ALARM CONTROLS AND DIRECTED AUDIO EVACUATION

CROSS-REFERENCE TO RELATED APPLICATIONS

The present disclosure claims the benefit of and priority to U.S. Provisional Application No. 62/679,323, titled "SYSTEMS AND METHODS OF ALARM CONTROLS AND DIRECTED AUDIO EVACUATION," filed Jun. 1, 2018, the disclosure of which is incorporated herein by reference in its entirety.

BACKGROUND

Alarms can be used in buildings to alert building occupants of various conditions, such as if a fire has been detected. Alarms can be triggered by sensors that detect certain conditions and output an indication of the detected conditions. Alarms can output audio and/or visual notifications regarding the detected conditions.

SUMMARY

One implementation of the present disclosure is a signaling device control system. The signaling device control system includes a user interface and an association mapper. The user interface presents a user interface tool including one or more features of a building and receives (i) a first input indicating a boundary of the building, (ii) a second input indicating a predetermined equation parameter, (iii) a third input indicating an initiating device assigned to a space defined by the boundary, and (iv) a fourth input indicating a signaling device assigned to the space defined by boundary. The association mapper generates a response function defining a response of the signaling device to a detection signal outputted by the initiating device based on the first input, the second input, the third input, and the fourth input, and outputs instructions to at least one of the signaling device and a fire control panel that controls operation of the signaling device to cause the signaling device to execute the response defined by the response function in response to the detection signal.

Another implementation of the present disclosure is a method of operating a signaling device control system. The method includes presenting, at a user interface, a user interface tool including a map of a building. The method includes receiving, via the user interface, (i) a first input indicating a boundary of the building, (ii) a second input indicating a predetermined equation parameter, (iii) a third input indicating an initiating device assigned to a space defined by the boundary, and (iv) a fourth input indicating a signaling device assigned to the space defined by boundary. The method includes generating, by an association mapper, a response function defining a response of the signaling device to a detection signal outputted by the initiating device based on the first input, the second input, the third input, and the fourth input. The method includes outputting, by the association mapper, instructions to at least one of the signaling device and a fire control panel that controls operation of the signaling device to cause the signaling device to execute the response defined by the response function in response to the detection signal.

Another implementation of the present disclosure is a directed audio notification system. The directed audio notification system includes a user interface and a directed audio generator. The user interface presents a directed audio generator tool that includes a map of a building and receives (i) a first input indicating a boundary assigned to the map, (ii) a second input indicating an initiating device assigned to the map, (iii) a third input indicating a signaling device assigned to the map, and (iv) a fourth input indicating an audio message assigned to the map. The directed audio generator generates a response function defining a response of the signaling device to a detection signal outputted by the initiating device based on the first input, the second input, the third input, and the fourth input, and outputs instructions to at least one of the signaling device and a fire control panel that controls operation of the signaling device to cause the signaling device to execute the response defined by the response function in response to the detection signal, the response including the audio message indicated by the fourth input.

Another implementation of the present disclosure is a method of operating a directed audio notification system. The method includes presenting, at a user interface, a user interface tool including a map of a building. The method includes receiving, via the user interface, (i) a first input indicating a boundary assigned to the map, (ii) a second input indicating an initiating device assigned to the map, (iii) a third input indicating a signaling device assigned to the map, and (iv) a fourth input indicating an audio message assigned to the map. The method includes generating, by a directed audio generator, a response function defining a response of the signaling device to a detection signal outputted by the initiating device based on the first input, the second input, the third input, and the fourth input. The method includes outputting, by the directed audio generator, instructions to at least one of the signaling device and a fire control panel that controls operation of the signaling device to cause the signaling device to execute the response defined by the response function in response to the detection signal.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

The present disclosure relates generally to the field of alarm systems. More particularly, the present disclosure relates to systems and methods of generating and executing instructions that control alarm systems, such as a floor-suites alarm system, as well as directed audio notifications using alarm systems.

A. Systems and Methods of Floor-Suites Alarm Systems

Systems and methods in accordance with the present disclosure can improve the operation of alarm systems, including how specific signaling devices respond to alarm conditions, by executing an association mapper that automatically associates signaling devices to alarm conditions, sensors, and other devices. In existing systems, a large number complex equations may be needed to completely determine how each signaling device in a building will respond to various conditions. The building may include several floors, each of which may include several suites, with signaling devices distributed throughout the building, each signaling device requiring specific rules for responding to various conditions based on inputs received from various other devices. For example, in a building with ten floors each including ten suites, the building may require eight general building equations, each floor may require six floor equations, and each suite may require 4 suite equations, resulting in four hundred sixty height total equations to be assigned for controlling every signaling device, as indicated in Equation 1 below:

$$NumberofEquations = \text{Building Equations} + \text{Floors} \times \left(\frac{\text{Equations}}{\text{Floor}} + \left(\text{Suites} \times \frac{\text{Equations}}{\text{Suite}}\right)\right) \quad \text{Eqn. 1}$$

Generating a large number of such equations can be a time-consuming and error-prone process. If customization is desired for the alarm system solution, such as to ensure that building occupants are provided specific, accurate notifications regarding alarm conditions and instructions for moving away from sources of alarms, the complexity of the equation generating process will also continue to increase. At the same time, it can be important to accurately generate the equations to ensure that fires and other alarm conditions are properly handled, including to ensure that occupants in the building receive safe instructions for evacuating the building. The present solution can address such challenges by using an assignment mapper that automatically assigns signaling device responses to respective conditions and initiating devices that trigger those responses.

Figure 1:
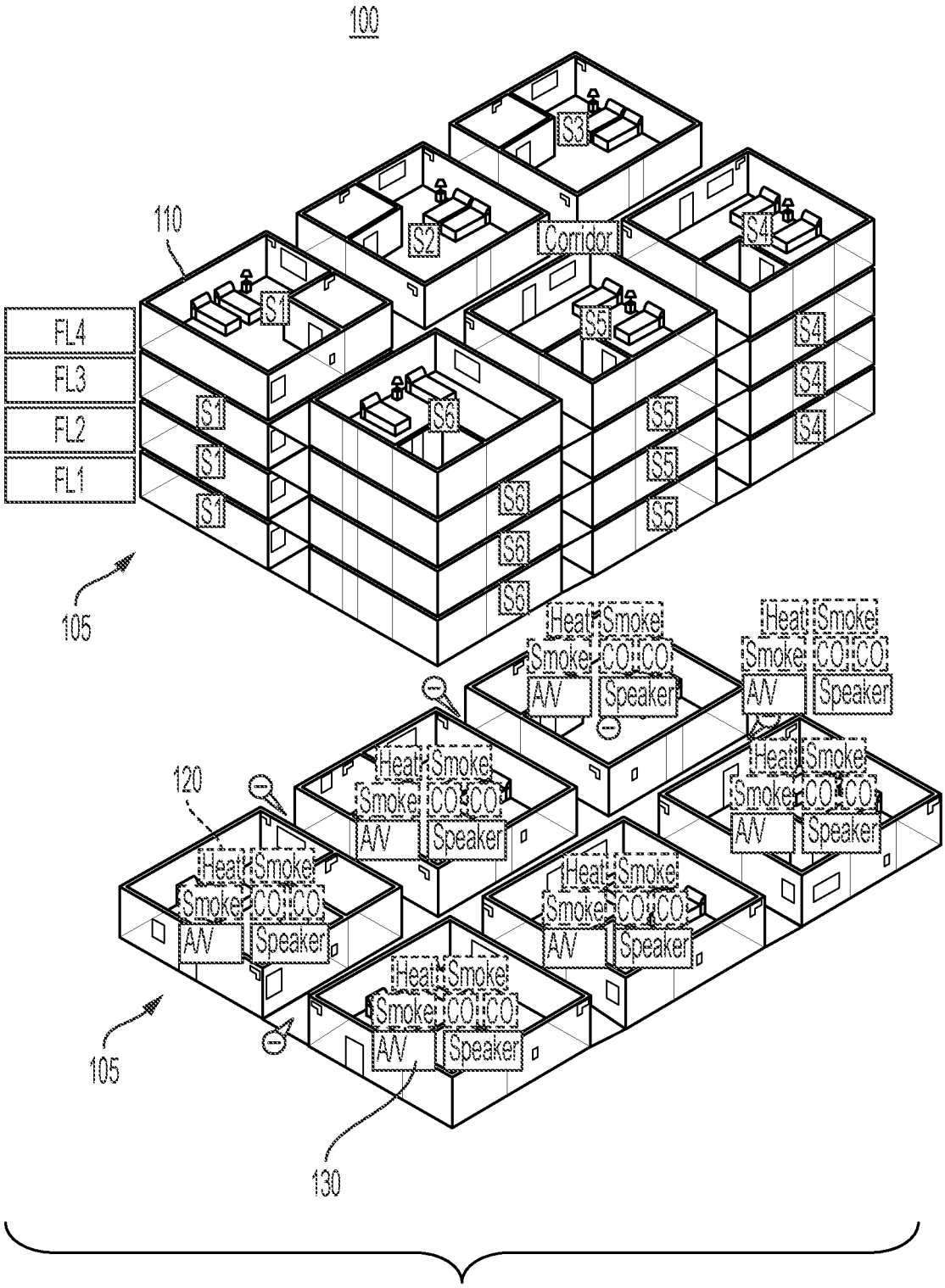
FIG. 1 is a schematic diagram of a building according to an exemplary embodiment.

Referring now to FIG. 1, a schematic diagram of a building 100 is depicted. The building 100 includes a plurality of floors 105. Each floor can include one or more suites 110.

The building 100 includes one or more initiating devices 120. The initiating device 120 can include a sensor that detects a sensed condition and outputs a detection signal responsive to detecting the sensed condition. The initiating devices 120 can include temperature sensors. The initiating devices 120 can include carbon monoxide sensors or other smoke sensors. The initiating device 120 can include a manual alarm device. The initiating devices 120 can detect a fire condition. The initiating devices 120 can output the detection signal responsive to detecting the fire condition. For example, the initiating devices 120 can compare a detected temperature to a threshold temperature associated with the fire condition, and output the detection signal responsive to detecting the fire condition.

The building 100 includes one or more signaling devices 130. The signaling devices 130 can output a notification based on detection signals outputted by the one or more initiating devices 120. For example, if the signaling device 130 operates as a fire alarm, the signal device 130 may output a notification of the fire alarm The signaling devices 130 can include an audio output device. The signaling devices 130 can include a visual output device, such as a light or a display.

Figure 2:
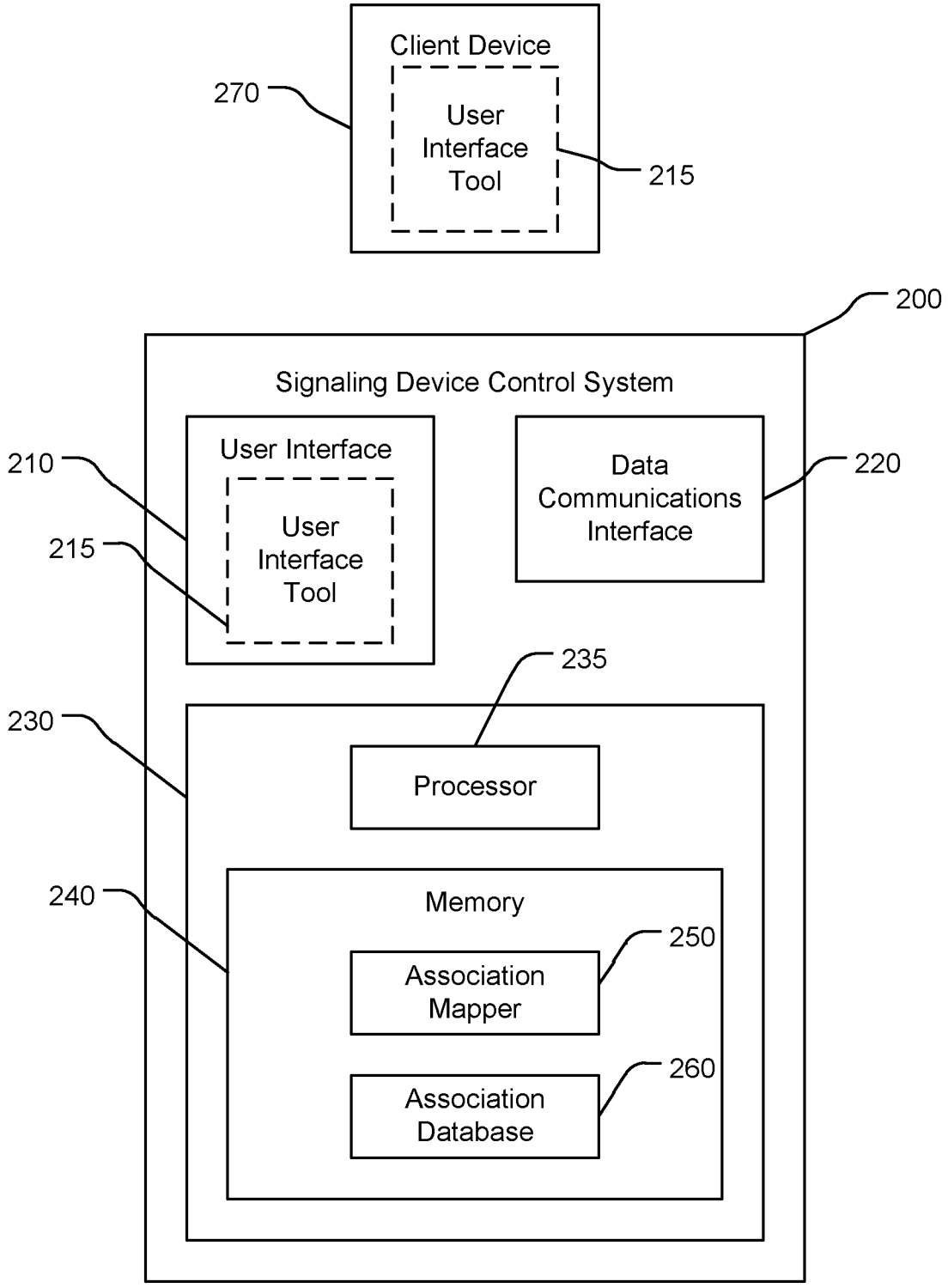
FIG. 2 is a block diagram of a signaling device control system according to an exemplary embodiment.

Referring now to FIG. 2, a block diagram of a signaling device control system 200 is depicted. The signaling device control system 200 can control operation of the signaling devices 130 of FIG. 1, such as to provide instructions (e.g., executable instructions) to each signaling device 130 to instruct each signaling device 130 to respond to selected detection signals outputted by the initiating devices 120. The signaling device control system 200 can receive the detection signals from the initiating devices 120 and control operation of the signaling devices 130 based on the received detection signals. The signaling device control system 200 can output instructions to each signaling device 130, such that each signaling device 130 can receive respective instructions and operate based on the received instructions. The signaling device control system 200 can be implemented by a fire control panel or can be remote from a fire control panel.

The signaling device control system 200 includes a user interface 210. The user interface 210 can include a display device and a user input device. The display device and user input device can each be components of an integral device (e.g., touchpad, touchscreen, device implementing capacitive touch or other touch inputs). The user input device may include one or more buttons, dials, sliders, keys, or other input devices configured to receive input from a user. The display device may include one or more display devices (e.g., LEDs, LCD displays, etc.). The user interface may also include output devices such as speakers, tactile feedback devices, or other output devices configured to provide information to a user. The user input device can include a microphone, and the processing circuit 230 can include a voice recognition engine configured to execute voice recognition on audio signals received via the microphone, such as for extracting commands from the audio signals.

The signaling device control system 200 includes a data communications interface 220. The data communications interface 220 may include wired or wireless interfaces (e.g., jacks, antennas, transmitters, receivers, transceivers, wire terminals, etc.) for conducting data communications with various systems, devices, or networks. For example, the data communications interface 220 may include an Ethernet card and/or port for sending and receiving data via an Ethernet-based communications network. In some embodiments, the data communications interface 220 includes a wireless transceiver (e.g., a WiFi transceiver, a Bluetooth transceiver, a NFC transceiver, ZigBee, etc.) for communicating via a wireless communications. The data communications interface 220 may be configured to communicate via a network associated with local area networks (e.g., a building LAN, etc.) and/or wide area networks (e.g., the Internet, a cellular network, a radio communication network, etc.) and may use a variety of communications protocols (e.g., BACnet, TCP/IP, point-to-point, etc.).

The signaling device control system 200 includes a processing circuit 230 including a processor 235 and a memory 240. The processor 235 may be a general purpose or specific purpose processor, an application specific integrated circuit (ASIC), one or more field programmable gate arrays (FPGAs), a group of processing components, or other suitable processing components. The processor 235 may be configured to execute computer code or instructions stored in memory 240 (e.g., fuzzy logic, etc.) or received from other computer readable media (e.g., CDROM, network storage, a remote server, etc.) to perform one or more of the processes described herein. The memory 240 may include one or more data storage devices (e.g., memory units, memory devices, computer-readable storage media, etc.) configured to store data, computer code, executable instructions, or other forms of computer-readable information. The memory 240 may include random access memory (RAM), read-only memory (ROM), hard drive storage, temporary storage, non-volatile memory, flash memory, optical memory, or any other suitable memory for storing software objects and/or computer instructions. The memory 240 may include database components, object code components, script components, or any other type of information structure for supporting the various activities and information structures described in the present disclosure. The memory 240 may be communicably connected to the processor 235 via the processing circuit 230 and may include computer code for executing (e.g., by processor 240) one or more of the processes described herein. The memory 240 can include various modules (e.g., circuits, engines) for completing processes described herein.

The memory 240 includes an association mapper 250. The association mapper 250 executes an association policy to generate response functions (e.g., equations) defining relationships between signaling devices 130, initiating devices 120, and the responses of signaling devices 130 to detection signals outputted by initiating devices 120. The association mapper 250 can maintain the generated response functions in an association database 260. By using the association mapper 250, the signaling device control system 200 can reduce the number of individual equation setting actions required to accurately determine how each signaling device 130 should respond. The signaling device control system 200 can reduce data storage requirements while also reducing errors in the equations maintained in the association database 260.

The association mapper 250 can provide to the user interface 210 a user interface tool 215, such as a wizard that can be used to present information using user interface 210 and receive inputs via user interface 210. The user interface tool 215 can include features of a building, such as a map of a building or a list of one or more floors, suites, or other parts of a building, that the user interface 210 can present. The map of the building as presented can be similar to the building 100 illustrated in FIG. 1. The user interface 210 can be of a client device 270 remote from the processing circuit 230 that the processing circuit 230 communicates with using data communications interface 220.

The association mapper 250 can receive an input indicative of a boundary of the building via the user interface 210. The boundary can define a space of the building. The boundary may be a closed boundary or an open boundary. The association mapper 250 can determine, based on the input, an indication of a space defined by the boundary. For example, the association mapper 250 can determine the boundary to define a floor, a suite, or a corridor. The association mapper 250 can cause the user interface 210 to present input options representative of the space defined by the boundary, and determine the indication of the space defined by the boundary based on the received input option. For example, the association mapper 250 can receive an input based on movement of a display item, such as a label, that was placed adjacent to a corresponding space in the map of the building.

The association mapper 250 can receive an input indicative of a predetermined equation parameter via the user interface 210. The predetermined equation parameter can correspond to at least one of a message parameter, a channel parameter, a priority parameter, or a tracking parameter. The message parameter can indicate a message to be outputted, such as an audio message (e.g., a language-based message or one or more noises) or a visual message (e.g., a displayed message or one or more light outputs). The channel parameter can indicate a channel on which the signaling device 130 is to operate. The priority parameter can indicate a priority associated with outputting a particular message (e.g., depending on the detection signal from the initiating device 120). The tracking parameter can indicate a data entry in memory of the fire control panel associated with the detection signal. The association mapper can determine the predetermined equation parameters to correspond to specific trigger conditions, such as events, based on the detection signal. For example, each of an alarm condition, a pre-alarm condition, a manually triggered condition, a smoke condition, or a carbon monoxide condition may be associated with a corresponding message parameter, channel parameter, priority parameter, and/or tracking parameter.

The association mapper 250 can receive an input indicative of an assignment of a device to a particular boundary of the building, such as an assignment of the device to a space corresponding to the boundary. The device can include the initiating device 120. For example, the device can include a temperature sensor or a smoke sensor. The device can include the signaling device 130. For example, the device can include an audio output device, a display, or a light. The association mapper 250 can maintain the assignment of the device to the particular boundary in the association database 260. The association mapper 250 can maintain multiple assignments for each device, such that one or more boundaries are assigned to each device. For example, the association mapper 250 can maintain an assignment of a fire alarm to both a floor boundary and a suite boundary.

The association mapper 250 can determine whether each device is an input device or an output device based on a type of the device. For example, if the device is an initiating type device (e.g., initiating device 120), the association mapper 250 can determine the device to be an input device. If the device is a signaling type device (e.g., signaling device 130), the association mapper 250 can determine the device to be an output device.

The association mapper 250 can generate a response function defining a response of each signaling device 130 based on the or more boundaries assigned to the signaling device 130 and the predetermined equation parameters assigned to the one or more boundaries. The association mapper 250 can retrieve the one or more boundaries assigned to the signaling device 130 from the association database 260. For each retrieved boundary, the association mapper 250 can identify one or more input devices, such as initiating devices 120 assigned to the same boundary. For each retrieved boundary, the association mapper 250 can identify one or more predetermined equation parameters.

Using the identified initiating device(s) 120 and predetermined equation parameter(s), the association mapper 250 can automatically generate one or more response functions defining one or more corresponding responses of the signaling device 130. For example, the association mapper 250 can automatically generate an alarm condition equation for the signaling device 130 based on a particular boundary assigned to the signaling device 130, predetermined equation parameters for the alarm condition assigned to the particular boundary, and the identification of the input devices (e.g., initiating devices 120) also assigned to the particular boundary. The association mapper 250 can provide the generated equations to each device in the building, so that the devices respond to various conditions based on the generated equations.

The association mapper 250 can execute an error checking function, which can increase the accuracy of the equations maintained in the association database 260. For example, the association mapper 250 can execute the error checking function to iterate through each boundary to determine whether each boundary is assigned to at least one initiating device 120 and at least one signaling device 130, and output an indication of an error responsive to determining that the boundary does not include at least one initiating device 120 and at least one signaling device 130. As such, the association mapper 250 can ensure that each space in the building corresponding to each boundary will be properly configured to respond to various conditions before the signaling devices 130 are made operational.

The association mapper 250 can execute the error checking function to determine compatibility between input devices (e.g., initiating devices 120) and output devices (e.g., signaling devices 130). For example, the association mapper 250 can maintain a data structure identifying, for each type of initiating device 120 and for each type of signaling device 130, one or more compatibility characteristics, such as standards, protocols, or other indications of compatibility used by the respective devices 120, 130. The association mapper 250 can retrieve the type of each initiating device 120 and signaling device 130 from the association database 260, and use the retrieved types to retrieve the corresponding compatibility characteristic(s), and compare the compatibility characteristic(s) to determine whether initiating device(s) 120 are compatible with signaling device(s) 130. For example, the association mapper 250 can determine compatibility amongst initiating device(s) 120 and signaling device(s) 130 assigned to each boundary. The association mapper 250 can output an indication of an error responsive to one or more initiating devices 120 being determined to be not compatible with one or more signaling devices 130, such as if the association mapper 250 determines that a particular initiating device 120 does not any have compatibility characteristic that matches any of the compatibility characteristics of a particular signaling device 130 assigned to the same boundary. The association mapper 250 can maintain indications of which compatibility characteristics do match between initiating devices 120 and signaling devices 130, such as to provide instructions to the initiating devices 120 and/or to the signaling devices 130 (or to a fire control panel that operates the initiating devices 120 and/or to the signaling devices 130) to operate according to an appropriate protocol that matches the corresponding other devices assigned to the same boundary.

Figure 3:
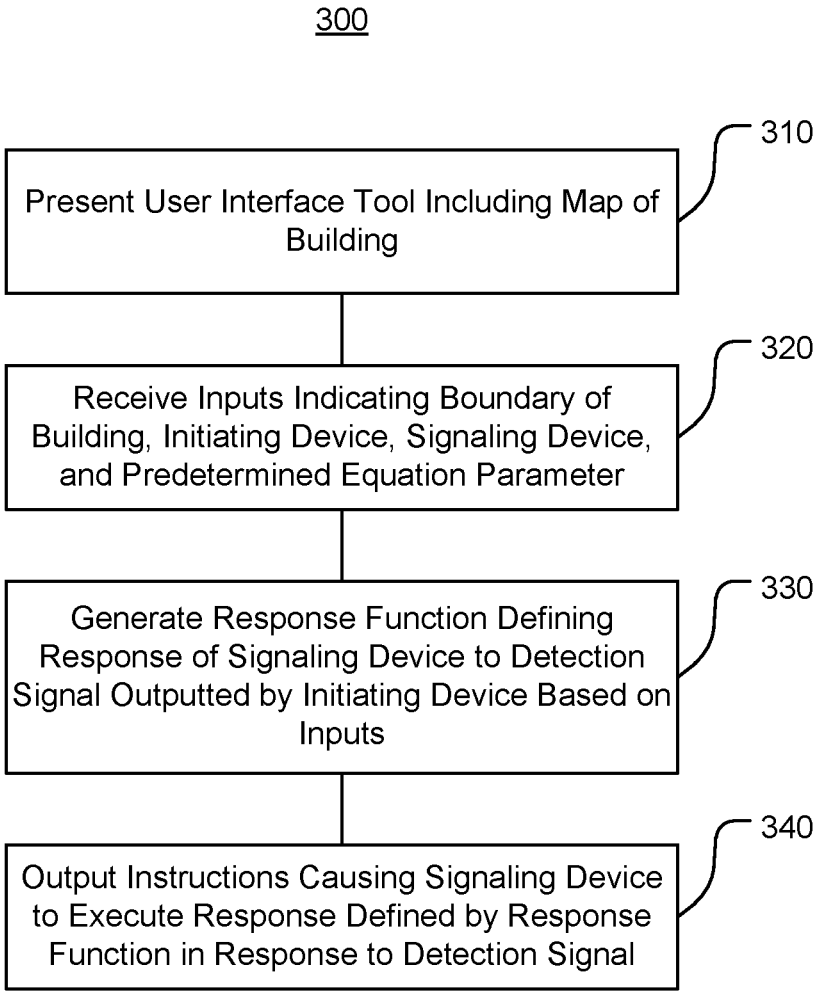
FIG. 3 is a flow diagram of a method of operating a signaling device control system according to an exemplary embodiment.

Referring now to FIG. 3, a method 300 of operating a signaling device control system is depicted. The method 300 can be executed using the signaling device control system of FIG. 2.

At 310, a user interface tool including a map of a building is presented at a user interface. The user interface tool can be presented using a user interface of the signaling device control system or a client device remote from the signaling device control system that the signaling device control system communicates with using a data communications interface.

At 320, a first input indicating a boundary of the building, a second input indicating a predetermined equation parameter, a third input indicating an initiating device assigned to a space defined by the boundary, and a fourth input indicating a signaling device assigned to the space defined by boundary are received via the user interface. The building can include various zones, such as floors, suites, and corridors, which the first input can correspond to. The predetermined equation parameter can correspond to at least one of a message parameter, a channel parameter, a priority parameter, or a tracking parameter. The message parameter can indicate a message to be outputted, such as an audio message or a visual message. The channel parameter can indicate a channel on which the signaling device is to operate. The priority parameter can indicate a priority associated with outputting a particular message depending on the detection signal from the initiating device. The tracking parameter can indicate a data entry in memory of the fire control panel associated with the detection signal. The initiating device can include at least one of a temperature sensor, a smoke sensor, and a carbon monoxide sensor. The signaling device can include at least one of an audio output device, a display, and a light. An association database can be used to assign the predetermined equation parameter to the boundary based on the first input and the second input, the initiating device to the boundary based on the first input and the third input, and the signaling device to the boundary based on the first input and the fourth input.

At 330, a response function is generated by an association mapper based on the inputs. The response function defines a response of the signaling device to a detection signal outputted by the initiating device based on the first input, the second input, the third input, and the fourth input. The response can include outputting a specific audio message, displayed image or video, light pattern, or other audio or visual output based on the detection signal and the boundary to which the signaling device is assigned.

At 340, instructions are outputted, by the association mapper, to at least one of the signaling device and a fire control panel that controls operation of the signaling device to cause the signaling device to execute the response defined by the response function in response to the detection signal.

The method 300 can include receiving, at the user interface, a fifth input indicating a second signaling device assigned to the boundary. The second signaling device can be determined to be of a same type as the signaling device. Instructions can be outputted to cause the second signaling device to execute the response defined by the response function in response to the detecting signal responsive to determining the second signaling device to be of a same type as the signaling device.

The method 300 can include executing an error checking function, which can increase the accuracy of the instructions outputted by the association mapper. For example, the association mapper can maintain a data structure identifying, for each type of initiating device and for each type of signaling device, one or more compatibility characteristics. The association mapper can compare the compatibility characteristic(s) to determine whether initiating device(s) are compatible with signaling device(s). The association mapper can output an indication of an error responsive to one or more initiating devices being determined to be not compatible with one or more signaling devices. The association mapper can maintain indications of which compatibility characteristics do match between initiating devices and signaling devices, such as to provide instructions to operate according to an appropriate protocol that matches the corresponding other devices assigned to the same boundary.

B. Systems Methods of Directed Audio Evacuation and Notifications

Systems and methods of directed audio evacuation and notifications in accordance with the present disclosure can improve the operation of alarm systems by increasing the accuracy and specificity of messages outputted by signaling devices, such as to enable directed audio evacuation. In existing systems, signaling devices may output notifications of alarm conditions using only a single notification that does not provide information specific to a location or other relationship of the signaling device to the cause of the alarm condition. For example, each signaling device in a building may output flashing lights, noises, or evacuation messages responsive to an alarm condition, but the outputted signals may be the same for every signaling device (of a same type, e.g. every signaling device that includes a light may flash the light; every signaling device that includes a speaker may output a same message). In existing systems, such customization may require individual generation of a large number of equations defining the behavior of the signaling devices. The present solution can improve upon existing systems by increasing the accuracy and specificity of the notifications outputted by the signaling devices while reducing the number of programming steps used to define the behavior of the signaling devices.

Figure 4:
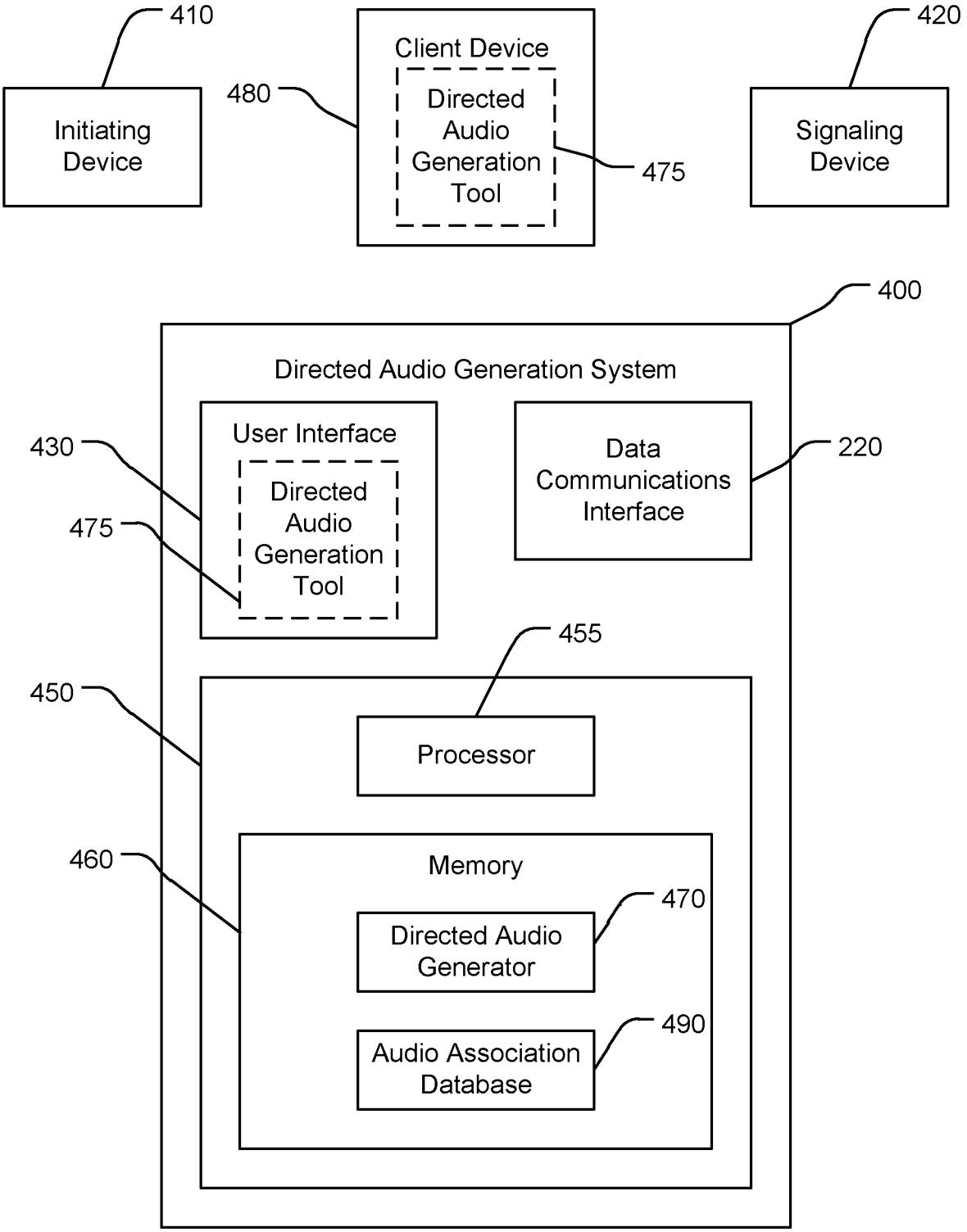
FIG. 4 is a block diagram of a directed audio notification system according to an exemplary embodiment.

Referring now to FIG. 4, a directed audio evacuation system 400 is depicted. The directed audio evacuation system 400 can communicate with and control operation of one or more initiating devices 410, which can be similar to the initiating devices 120 of FIG. 1. The directed audio evacuation system 400 can communicate with and control operation of one or more signaling devices 420, which can be similar to the signaling devices 130 of FIG. 1, and can output audio information, such as audio messages. The directed audio evacuation system 400 can be implemented by a fire control panel or can be remote from a fire control panel. The directed audio evacuation system 400 can be used to output messages relating to evacuation pathways, active shooter alerts, fire conditions, alarm conditions, smoke conditions, or various other notifications in which it may be useful to The directed audio evacuation system 400 includes a user interface 430 (which can be similar to user interface 210 of FIG. 2), a data communications interface 440 (which can be similar to data communications interface 220 of FIG. 2), and a processing circuit 450 (which can be similar to processing circuit 230 of FIG. 2) including a processor 455 and a memory 460.

The memory 460 includes a directed audio generator 470. The directed audio generator 470 can operate in a similar manner as the association mapper 250 of FIG. 2, such as by providing to the user interface 430 a directed audio generator tool 475 that can be used to present information using user interface 430 and receive inputs via user interface 430. The user interface 430 may be implemented by a client device 480 remote from processing circuit 450. The directed audio generator 470 can maintain in an audio association database 490 assignments of boundaries and messages to signaling devices 420 as described herein.

The directed audio generator tool 475 can include features of a building, such as a map of a building. The map of the building can be similar to the building 100 depicted in FIG. 1, as well as to the directed audio evacuation diagram 500 described with reference to FIG. 5.

The directed audio generator 470 can receive an input indicating instructions to assign a boundary to the map building. For example, the directed audio generator 470 can receive an input indicating a boundary being positioned adjacent to a region of the building, such as a floor, corridor, or suite.

The directed audio generator 470 can receive an input indicating instructions to assign an initiating device 410 (e.g., an input device) to a location of the map of the building. The directed audio generator 470 can receive an input indicating instructions to assign a signaling device 420 (e.g., an output device) to a location of the map of the building. The directed audio generator 470 can assign the respective initiating device(s) 410 and signaling device(s) 420 to the corresponding boundaries assigned to the map of the building. The input can correspond to movement of a display item corresponding to the initiating device 410 (or signaling device 420) to the location.

The directed audio generator 470 can receive an input indicating instructions to assign an audio message to a particular boundary (e.g., to a zone of the map of the building corresponding to the particular boundary). The input can correspond to movement of a display item corresponding to the audio message to a position corresponding to the particular boundary.

The directed audio generator 470 can generate, for each signaling device 420, a response function (e.g., equation) defining a response of the signaling device 420 to various conditions, and maintain the response functions in the audio association database 490. For example, the directed audio generator 470 can identify a particular boundary assigned to the signaling device 420. The directed audio generator 470 can retrieve from the audio association database 490 at least one audio message assigned to the particular boundary, and assign the at least one audio message to the signaling device 420 responsive to retrieving the at least one audio message. The directed audio generator 470 can retrieve from the audio association database 490 at least one initiating device 410 assigned to the particular boundary, and assign the retrieved at least one initiating device 410 to the signaling device 420 so that the signaling device 420 can be instructed to output the at least one audio message responsive to receiving a detection signal from the at least one initiating device 410. The directed audio generator 470 can generate instructions that can be provided to the signaling devices 420 (or to a fire control panel that operates the signaling devices 420) based on the corresponding response functions, such that the signaling devices 420 can use the respective response functions to determine if and how to respond to detection signals received from initiating devices 410.

The directed audio generator 470 can execute a safety function to verify the responses to be performed by the signaling devices 420. For example, the directed audio generator 470 can maintain safety criteria, such as a criteria indicating that the outputted audio messages should not direct occupants of a building in a direction towards an alarm condition. The directed audio generator 470 can determine a first direction indicated by the audio message, determine a second direction between the signaling device 420 and an alarm condition corresponding to the initiating device 410, compare the first direction to the second direction, and output an error condition responsive to the comparison indicating that the first direction and the second direction do not satisfy the safety criteria (e.g., the first direction would direct occupants towards a source of the alarm condition).

Figure 5:
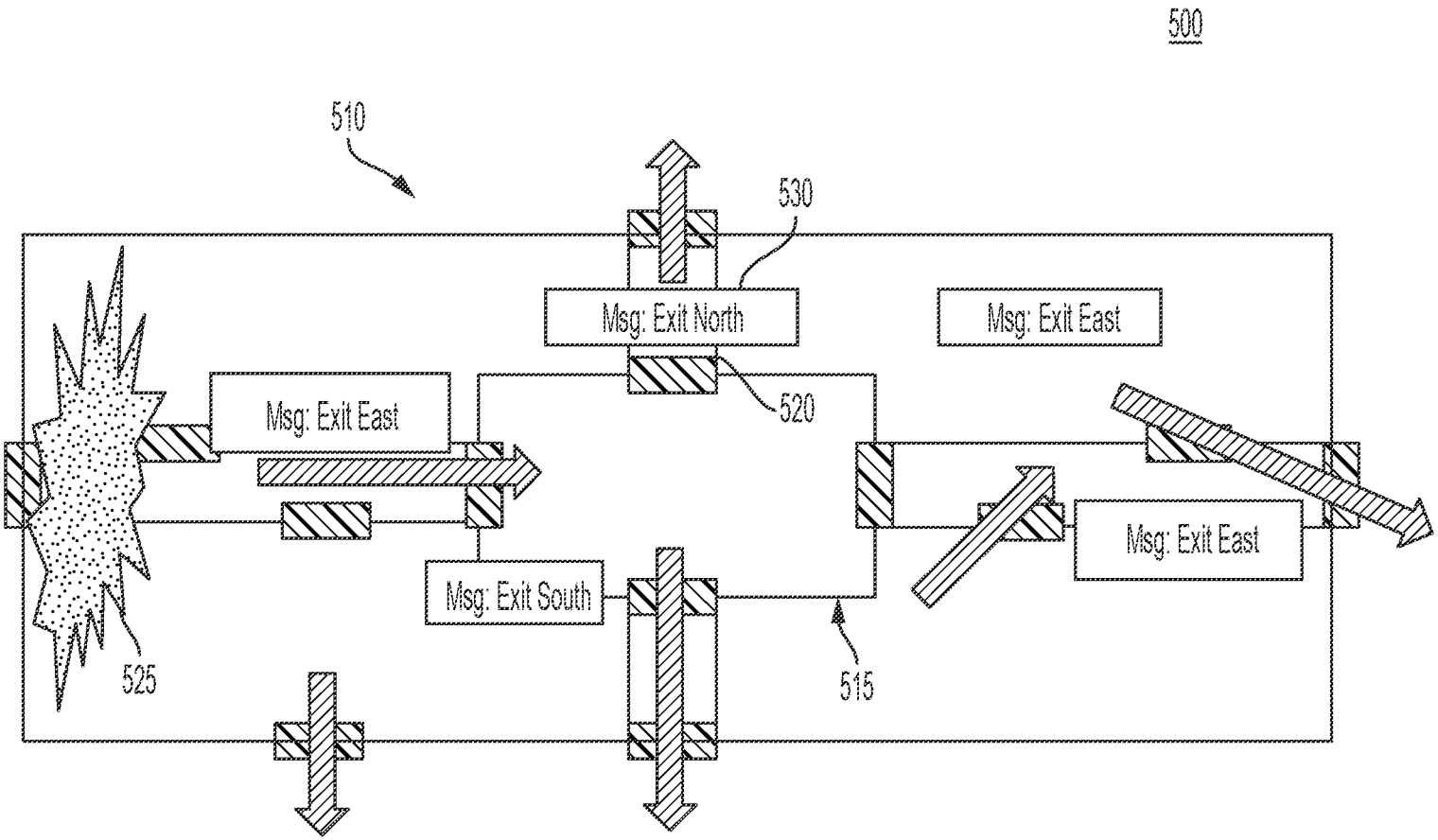
FIG. 5 is a schematic diagram of operation of a directed audio notification system according to an exemplary embodiment.

Referring now to FIG. 5, a schematic diagram representative of a directed audio evacuation diagram 500 generated by operation of the directed audio evacuation system 400 is depicted. The directed audio evacuation diagram 500 can be generated for a floor 510 of a building, which can be similar to the building 100 of FIG. 1. The floor 510 includes a plurality of zones 515, such as suites and corridors. A plurality of signaling devices 520 (which can be similar to signaling devices 420 of FIG. 4) are located at various locations on the floor 510. An initiating device (not shown) can detect an alarm condition 525, such as a fire, smoke, or active shooter, and output a detection signal indicating the alarm condition 525. The signaling devices 520 can output directed audio notifications 530 for evacuation based on the detection signals. For example, the signaling devices 520 may receive instructions from the directed audio generator 470 that can be used to determine how to respond to detection signals; a fire control panel (not shown) may receive instructions from the directed audio generator 470 and control operation of the signaling devices 520 to cause the signaling devices 520 to output specific directed audio notifications 530. As depicted in FIG. 5, various signaling devices 520 output varying audio notifications 530 depending on the instructions that have been provided to the signaling devices 520, those instructions having been automatically generated based on the assignments of the signaling devices 520 and audio notifications 530 by the directed audio generator 470 based on inputs received via the user interface 430.

Figure 6:
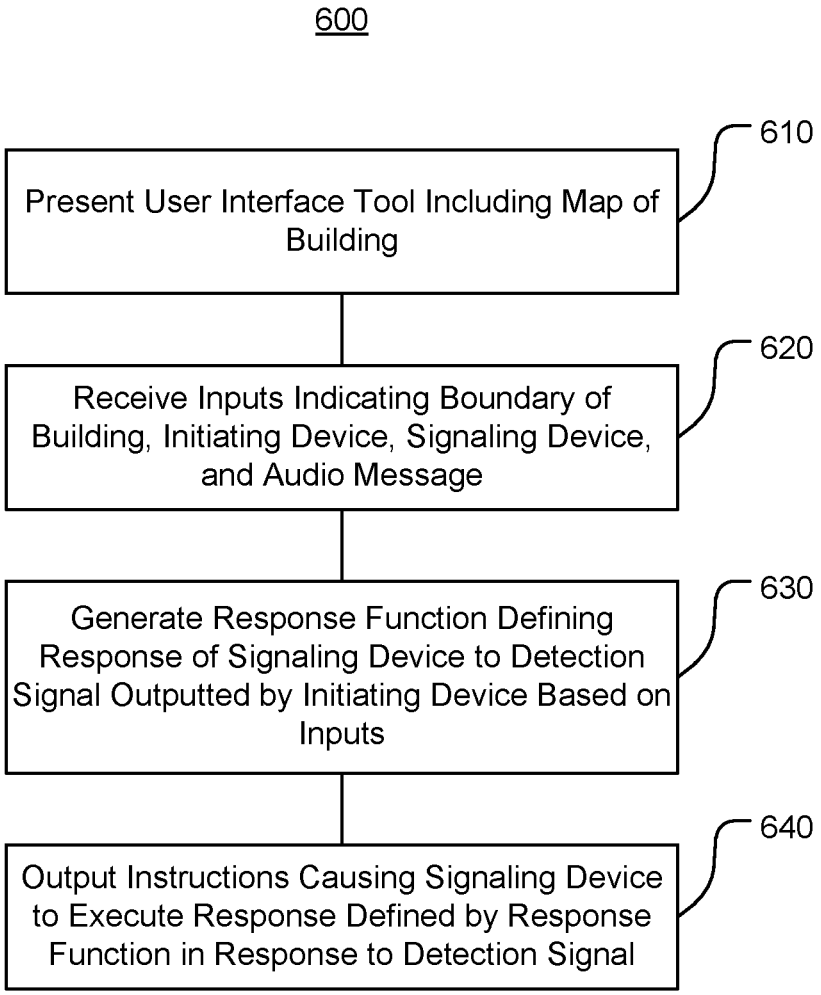
FIG. 6 is a flow diagram of a method of operating a directed audio notification system according to an exemplary embodiment.

Referring now to FIG. 6, a method 600 of operating a directed audio evacuation system is depicted. The method 600 can be performed using the directed audio evacuation system of FIG. 4.

At 610, a user interface tool including a map of a building is presented at a user interface. The user interface tool can be presented using a user interface of the signaling device control system or a client device remote from the signaling device control system that the signaling device control system communicates with using a data communications interface.

At 620, a first input indicating a boundary assigned to the map, a second input indicating an initiating device assigned to the map, a third input indicating a signaling device assigned to the map, and a fourth input indicating an audio message assigned to the map are received via the user interface. The building can include various zones, such as floors, suites, and corridors, which the first input can correspond to. The initiating device can include at least one of a temperature sensor, a smoke sensor, a manual alarm device, and a carbon monoxide sensor. The signaling device can include at least one of an audio output device, a display, and a light. The audio message can indicate specific notifications, such as directions, to be outputted to occupants of the building. An association database can be used to assign the initiating device to the audio message to the boundary based on the first input and the second input, the signaling device to the boundary based on the first input and the third input, and the audio message to the boundary based on the first input and the fourth input.

At 630, a response function is generated by a directed audio generator based on the inputs. The response function defines a response of the signaling device to a detection signal outputted by the initiating device based on the first input, the second input, the third input, and the fourth input. For example, the response function can define the response to include outputting a specific audio message, which may depend on the location of the signaling device and information indicated by the detection signal.

At 640, instructions are outputted, by the directed audio generator, to at least one of the signaling device and a fire control panel that controls operation of the signaling device to cause the signaling device to execute the response defined by the response function in response to the detection signal.

The method 600 can include receiving, via the user interface, a fifth input indicating a second signaling device assigned to the map. The directed audio generator can determine the second signaling device to be assigned to the boundary based on the first input and the fifth input. The directed audio generator can output instructions to cause the second signaling device to execute the response defined by the response function in response to the detection signal responsive to determining the second signaling device to be assigned to the boundary.

The method 600 can include executing a safety function to verify the responses to be performed by signaling devices, which can increase the accuracy and/or safety of the instructions outputted by the directed audio generator. The directed audio generator can maintain safety criteria, such as a criteria indicating that the outputted audio messages should not direct occupants of a building in a direction towards an alarm condition. The directed audio generator can determine a first direction indicated by the audio message, determine a second direction between the signaling device and an alarm condition corresponding to the initiating device, compare the first direction to the second direction, and output an error condition responsive to the comparison indicating that the first direction and the second direction do not satisfy the safety criteria (e.g., the first direction would direct occupants towards a source of the alarm condition).

References to "or" may be construed as inclusive so that any terms described using "or" may indicate any of a single, more than one, and all of the described terms. References to at least one of a conjunctive list of terms may be construed as an inclusive OR to indicate any of a single, more than one, and all of the described terms. For example, a reference to "at least one of" 'A' and 'B' can include only 'A', only 'B', as well as both 'A' and 'B'. Such references used in conjunction with "comprising" or other open terminology can include additional items.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure can be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps can be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A signaling device control system, comprising:

a user interface that presents a user interface tool including a map of a building and receives (i) a first input indicating a boundary of the building, (ii) a second input indicating a predetermined equation parameter, (iii) a third input indicating an initiating device assigned to a space defined by the boundary, and (iv) a fourth input indicating a signaling device assigned to the space defined by boundary;

an association mapper that generates a response function defining a response of the signaling device to a detection signal outputted by the initiating device based on the first input, the second input, the third input, and the fourth input, and outputs instructions to at least one of the signaling device and a fire control panel that controls operation of the signaling device to cause the signaling device to execute the response defined by the response function in response to the detection signal; and an association database that the association mapper uses to assign the predetermined equation parameter to the boundary based on the first input and the second input, the initiating device to the boundary based on the first input and the third input, and the signaling device to the boundary based on the first input and the fourth input.

2. The signaling device control system of claim 1, comprising:

the initiating device includes at least one of a temperature sensor, a smoke sensor, and a carbon monoxide sensor.

3. The signaling device control system of claim 1, comprising:

the signaling device includes at least one of an audio output device, a display, and a light.

4. The signaling device control system of claim 1, comprising:

the predetermined equation parameter includes at least one of (i) a message parameter indicating a message to be outputted by the signaling device, (ii) a channel parameter indicating a channel on which the signaling device is to operate, (iii) a priority parameter indicating a priority corresponding to the message parameter, and (iv) a tracking parameter indicating a data entry in memory of the fire control panel associated with the detection signal.

5. The signaling device control system of claim 1, comprising:

the user interface receives a fifth input indicating a second signaling device assigned to the boundary; and the association mapper determines the second signaling device to be of a same type as the signaling device and outputs instructions to cause the second signaling device to execute the response defined by the response function in response to the detecting signal responsive to determining the second signaling device to be of the same type as the signaling device.

6. The signaling device control system of claim 1, comprising:

the association mapper outputs an error condition based on executing an error checking function to determine that the initiating device is not compatible with the signaling device.

7. A method of operating a signaling device control system, comprising:

presenting, at a user interface, a user interface tool including a map of a building;

receiving, via the user interface, (i) a first input indicating a boundary of the building, (ii) a second input indicating a predetermined equation parameter, (iii) a third input indicating an initiating device assigned to a space defined by the boundary, and (iv) a fourth input indicating a signaling device assigned to the space defined by boundary;

generating, by an association mapper, a response function defining a response of the signaling device to a detection signal outputted by the initiating device based on the first input, the second input, the third input, and the fourth input;

outputting, by the association mapper, instructions to at least one of the signaling device and a fire control panel that controls operation of the signaling device to cause the signaling device to execute the response defined by the response function in response to the detection signal;

receiving, at the user interface, a fifth input indicating a second signaling device assigned to the boundary;

determining, by the association mapper, the second signaling device to be of a same type as the signaling device; and outputting, by the association mapper, instructions to cause the second signaling device to execute the response defined by the response function in response to the detecting signal responsive to determining the second signaling device to be of a same type as the signaling device.

8. The method of claim 7, comprising:

the initiating device includes at least one of a temperature sensor, a smoke sensor, and a carbon monoxide sensor.

9. The method of claim 7, comprising:

assigning, by the association mapper using an association database, the predetermined equation parameter to the boundary based on the first input and the second input, the initiating device to the boundary based on the first input and the third input, and the signaling device to the boundary based on the first input and the fourth input.

10. The method of claim 7, comprising:

the signaling device includes at least one of an audio output device, a display, and a light.

11. The method of claim 7, comprising:

the predetermined equation parameter includes at least one of (i) a message parameter indicating a message to be outputted by the signaling device, (ii) a channel parameter indicating a channel on which the signaling device is to operate, (iii) a priority parameter indicating a priority corresponding to the message parameter, and (iv) a tracking parameter indicating a data entry in memory of the fire control panel associated with the detection signal.

12. The method of claim 7, comprising:

outputting, by the association mapper, an error condition based on executing an error checking function to determine that the initiating device is not compatible with the signaling device.

13. A directed audio notification system, comprising:

a user interface that presents a directed audio generator tool that includes a map of a building and receives (i) a first input indicating a boundary assigned to the map, (ii) a second input indicating an initiating device assigned to the map, (iii) a third input indicating a signaling device assigned to the map, (iv) a fourth input indicating an audio message assigned to the map, and (v) a fifth input indicating a second signaling device assigned to the map; and a directed audio generator that:

generates a response function defining a response of the signaling device to a detection signal outputted by the initiating device based on the first input, the second input, the third input, and the fourth input, determines the second signaling device to be assigned to the boundary based on the first input and the fifth input, outputs instructions to at least one of the signaling device and a fire control panel that controls operation of the signaling device to cause the signaling device to execute the response defined by the response function in response to the detection signal, the response including the audio message indicated by the fourth input, and responsive to determining the second signaling device to be assigned to the boundary, outputs instructions to cause the second signaling device to execute the response defined by the response function in response to the detection signal.

14. The directed audio notification system of claim 13, comprising:

an association database that the directed audio generator uses to assign the initiating device to the audio message to the boundary based on the first input and the second input, the signaling device to the boundary based on the first input and the third input, and the audio message to the boundary based on the first input and the fourth input.

15. The directed audio notification system of claim 13, comprising:

the directed audio generator executes an error checking function to determine whether the audio message satisfies a safety criteria, and outputs an error condition responsive to the audio message not satisfying the safety criteria.

16. The directed audio notification system of claim 13, comprising:

the initiating device includes at least one of a temperature sensor, a smoke sensor, and a carbon monoxide sensor.

17. The directed audio notification system of claim 13, comprising:

the signaling device includes at least one of an audio output device, a display, and a light.

18. A method of operating a directed audio notification system, comprising:

presenting, at a user interface, a user interface tool including a map of a building;

receiving, via the user interface, (i) a first input indicating a boundary assigned to the map, (ii) a second input indicating an initiating device assigned to the map, (iii) a third input indicating a signaling device assigned to the map, and (iv) a fourth input indicating an audio message assigned to the map;

generating, by a directed audio generator, a response function defining a response of the signaling device to a detection signal outputted by the initiating device based on the first input, the second input, the third input, and the fourth input;

outputting, by the directed audio generator, instructions to at least one of the signaling device and a fire control panel that controls operation of the signaling device to cause the signaling device to execute the response defined by the response function in response to the detection signal; and assigning, by the directed audio generator using an association database, the initiating device to the audio message to the boundary based on the first input and the second input, the signaling device to the boundary based on the first input and the third input, and the audio message to the boundary based on the first input and the fourth input.

19. The method of claim 18, comprising:

receiving, via the user interface, a fifth input indicating a second signaling device assigned to the map;

determining, by the directed audio generator, the second signaling device to be assigned to the boundary based on the first input and the fifth input; and outputting, by the directed audio generator responsive to determining the second signaling device to be assigned to the boundary, instructions to cause the second signaling device to execute the response defined by the response function in response to the detection signal.

20. The method of claim 18, comprising:

executing, by the directed audio generator, a safety function to determine whether the audio message satisfies a safety criteria; and outputting, by the directed audio generator, an error condition responsive to the audio message not satisfying the safety criteria.

21. The method of claim 18, comprising:

the initiating device includes at least one of a temperature sensor, a smoke sensor, and a carbon monoxide sensor.

22. The method of claim 18, comprising:

the signaling device includes at least one of an audio output device, a display, and a light.

* * * * *